United States Patent [19]

Benilan

[11] Patent Number: 4,875,684

[45] Date of Patent: Oct. 24, 1989

[54] ORIENTABLE PLATFORM, IN PARTICULAR FOR TRAINING IN GOLF

[76] Inventor: Jacques Benilan, 151 Boulevard Haussmann, 75008 Paris, France

[21] Appl. No.: 146,204

[22] Filed: Jan. 20, 1988

[30] Foreign Application Priority Data

Jan. 20, 1987 [FR] France ..... 87 00588

[51] Int. Cl.[4] ..... A63B 69/36

[52] U.S. Cl. ..... 273/195 B; 272/93

[58] Field of Search ..... 273/195 R, 195 B, 183 A, 273/32 R, 35, 183 R, 197 R, 198; 272/93, 94, 96, 116, 44, 6

[56] References Cited

U.S. PATENT DOCUMENTS

| | | | |
|---|---|---|---|
| 1,612,291 | 12/1926 | Jackson | 273/176 H |
| 3,595,581 | 7/1971 | Anderson et al. | 273/176 H |
| 3,633,917 | 1/1972 | Anderson | 273/195 B |
| 3,633,918 | 1/1972 | Smiley | 273/195 A |
| 3,639,923 | 2/1972 | Stewart | 273/195 A |
| 3,869,127 | 3/1975 | Kohori | 273/195 A |

*Primary Examiner*—Edward M. Coven
*Assistant Examiner*—S. Passaniti
*Attorney, Agent, or Firm*—Wenderoth, Lind & Ponack

[57] ABSTRACT

A training or exercising device, in particular for the practice of golf, includes a fixed stand and an orientable platform, a support and articulation member for supporting the platform relative to the fixed stand, and two actuating jacks forming support and articulation elements. The two jacks and the support and articulation member are arranged in a substantially symmetrical manner around the center of the platform.

29 Claims, 5 Drawing Sheets

ORIENTABLE PLATFORM, IN PARTICULAR FOR TRAINING IN GOLF

BACKGROUND OF THE INVENTION

The present invention relates to an orientable platform for training or exercising which may be employed in particular in kinesitherapy, reeducation of ankles, knees or hips and in sports of skill such as golf, archery and clay pidgeon shooting.

A golf training device known from U.S. Pat. No. 3,633,917 includes an orientable platform which pivots on a central ball joint of large size carried by a frame resting on the ground.

This platform may be inclined by two vertical doubleacting jacks disposed at 90° to each other relative to the vertical axis through the center of the ball joint, these two jacks being located at a relatively short distance from the ball joint. The position of the ball is substantially located at the center of the platform, i.e. on the axis of the ball joint, and the feet of the player are offset outside the support area, which requires a very rigid and consequently heavy platform.

Moreover, in such an arrangement, bearing in mind the ball joint in the central position, the jacks act, depending on the position of the player, in two directions, namely in compression and in tension.

Furthermore, the jacks only take the forces in a partial manner since they only react against tipping forces.

The weight component is almost totally supported by the central ball joint which must be strong and of large size, which results in high manufacturing costs and a complex design.

SUMMARY OF THE INVENTION

An object of the invention is therefore to provide a device which may be inclined in a plurality of directions and which is capable of supporting an appreciable weight such as the weight of a man, and the reactions to violent shocks while being simple in construction, relatively light and inexpensive.

The invention provides a training or exercising device, in particular for practicing golf, comprising a fixed stand and an orientable platform, means for supporting and articulating the orientable platform relative to the fixed stand and two actuating jacks, wherein the two actuating jacks constitute moreover support and articulation elements, and the two jacks and the support and articulation means are disposed substantially at the apices of a equilateral triangle centered with respect to the platform.

BRIEF DESCRIPTION OF THE DRAWINGS

The invention will be described in more detail hereinafter with reference to the accompanying drawings which are given solely by way of example and in which.

DETAILED DESCRIPTION OF THE INVENTION

In order to simplify the description of the invention, there will only be described the application of the device in golf training, it being understood that this example is not limitative and that many other applications may be envisaged without departing from the scope of the invention.

Figure 1:
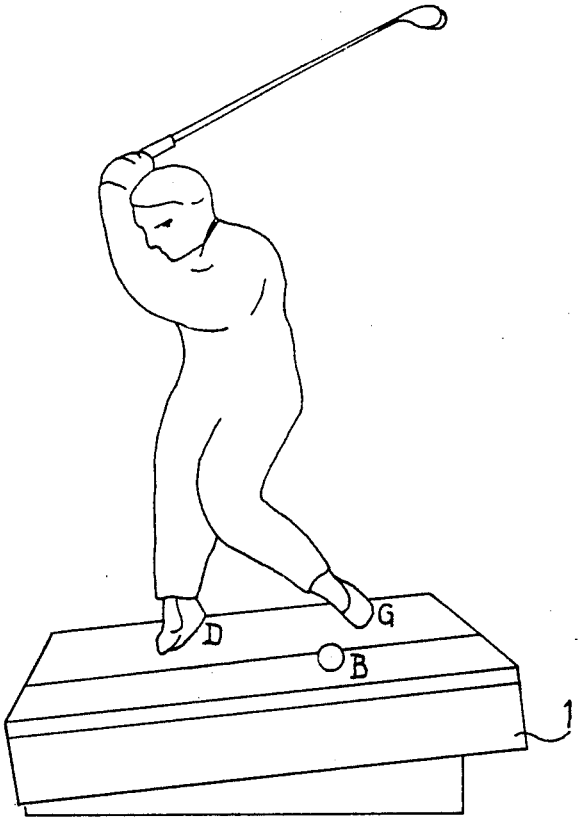
FIG. 1 is a simplified perspective view of a training device in the case of training in golf.

FIG. 1 is a simplified perspective view of the device 1 according to the invention, in the case of training or practicing of golf, in particular practicing of the golf swing. The device may be so oriented as to simulate the real conditions of the ground, as for example a slope chosen to be along the axis of a golf shot.

Figure 2:
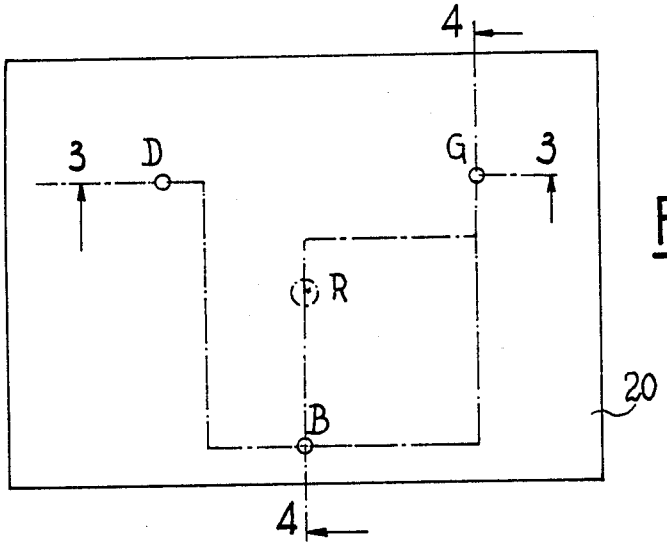
FIG. 2 is a diagrammatic top plan view of the device according to the invention with three support points.

FIG. 2 shows an embodiment in which an orientable platform 20 is supported at three points so positioned that the support points of feet G and D and the point at which a ball B is struck are disposed in a substantially symmetrical manner relative to the center C of the platform.

A recommended embodiment is therefore that in which a support and articulation means is located below the point B corresponding to the ball, a jack is located below the point G corresponding to the left foot of the player and a jack is located below the point D corresponding to the right foot of the player. Indeed, the jacks acting under compression are capable of supporting high instantaneous forces, in particular that which is transferred through the platform when the golfer swings his club and more particularly in the region of the point G when the golfer is a right-handed player. The support and articulation means below the point B receives less weight but must support the vibrations which are propagated consequent to the axial shocks coming from bad swings on the part of inexperienced players which strike against the platform before having struck the ball. The support and articulation means very close to the striking point is then all the more capable of supporting these shocks.

It will be seen in FIG. 2 that the orientable platform 20 has such area that, for a given distance between the feet of the player and for a correct position of the ball at point B, the triangle B,D,G is clearly inscribed within this orientable platform so that the player does not lack a supporting area.

Figure 3:
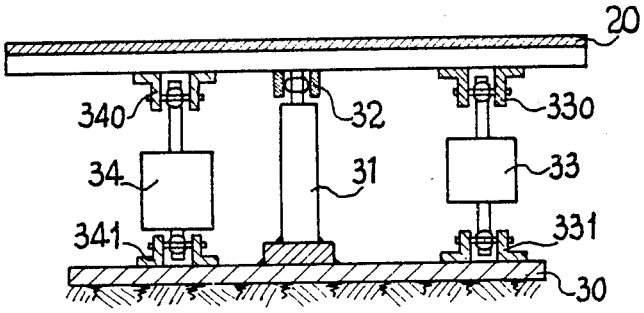
FIG. 3 is a diagrammatic sectional view taken on line 3—3 of FIG. 2 of an embodiment of the device.

FIG. 3 is a diagrammatic sectional view of an embodiment of the invention. This figure shows a fixed stand 30 resting on the ground and an orientable platform 20. Disposed between the fixed stand and the orientable platform is a fixed articulation and support means 31 constituted by a solid bar connected by any suitable means to the fixed stand, in particular by welding, while this bar is connected in its upper part by a ball joint 32 to the lower side of the orientable platform 20.

Further, two jacks 33 and 34 are connected to the lower side of the orientable platform 20 and to the fixed stand 30 by ball joint connections 330, 331 and 340, 341 respectively.

Figure 4:
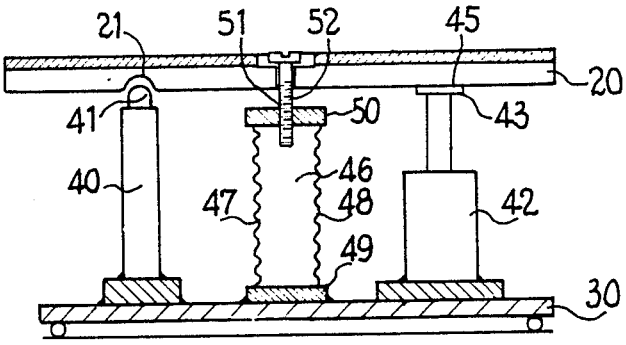
FIG. 4 is a diagrammatic sectional view taken on line 4—4 of FIG. 2 of an alternative embodiment of the device.

Another embodiment is shown in FIG. 4 which is a sectional view taken on line 4—4 of FIG. 2 in which a return spring device designated by the reference character R in FIG. 2 has been added. The fixed support and articulation means 40 of FIG. 4 is connected to the fixed stand 30 by any suitable means, in particular by welding as represented, while this fixed support means is provided in its upper part with a pivot sphere 41. This sphere 41 comes to bear in a corresponding hemispherical cavity 21 provided in the orientable platform 20. The jacks 42 are single acting and the upper ends 43 thereof are provided with sliding shoes 45 which cooperate with the lower side of the orientable platform 20.

The return spring device located between the orientable platform 20 and the stand 30 maintains this orientable platform 20 in bearing relation to the pivot sphere 41 and on the shoes 45 in all the positions that the orientable platform can assume. The return spring device comprises two springs 47, 48 under tension and disposed between a lower support 49 fixed to the stand 30 and a movable upper support 50. The latter support is provided with a tapped bore 51 in which is screwed a bolt 52 which extends through the orientable platform 20 and is accessible from the upper part of the platform. In the position of rest of the springs, the length of the bolt 52 is such that its lower part is capable of being screwed into the bore 51 of the upper support 50 and that by an additional screwing the upper support 50 can be brought into contact with the lower side of the orientable platform 20, which puts the springs 47, 48 under tension. In this way it is very simple to assemble and disassemble the platform.

It is possible to protect this device against an accidental disassembly by giving the head of the bolt 52 a special shape requiring a corresponding tool which is not commercially available.

Figure 5:
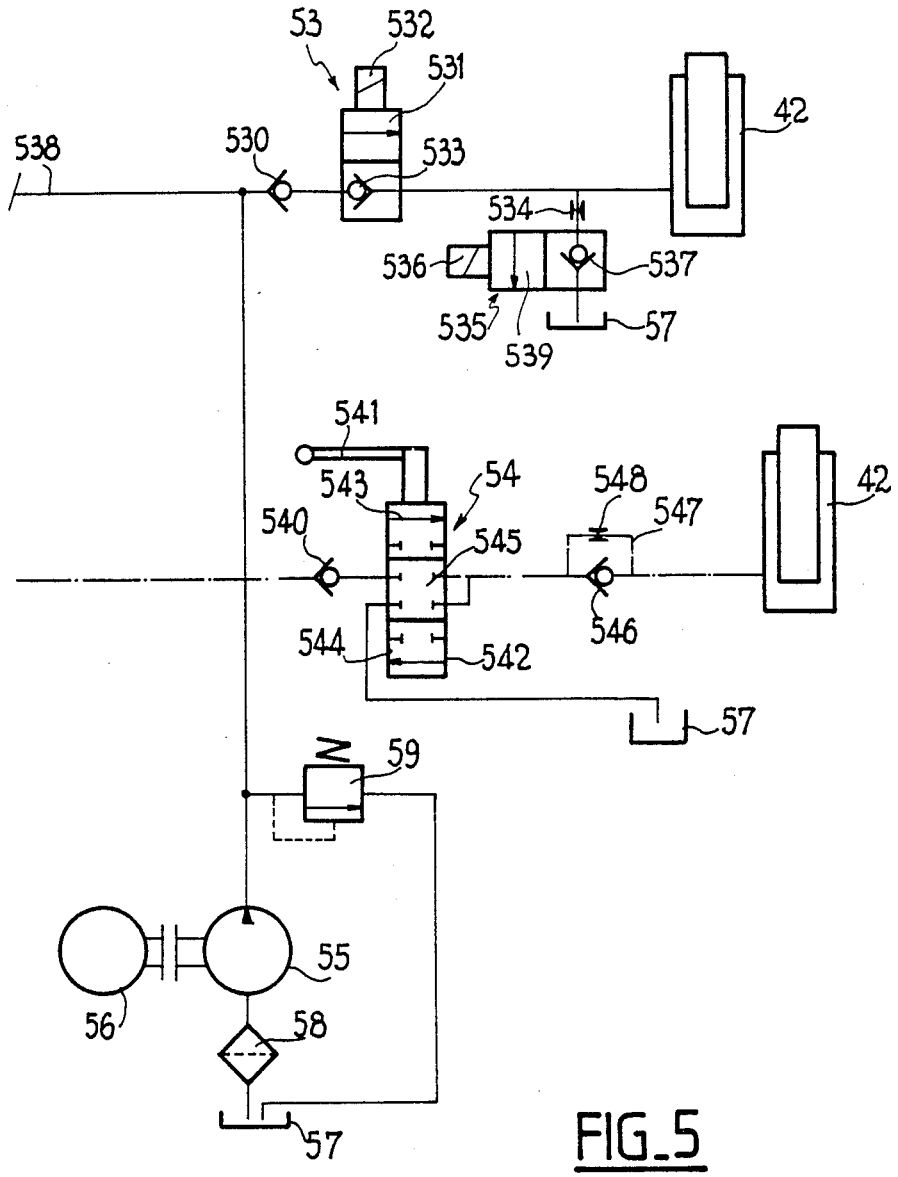
FIG. 5 is a diagram of the hydraulic control of the device provided with single-acting jacks each having a plunger.

In the embodiment shown in FIG. 5, the jacks 42 are of the known single-acting type and are hydraulic. These jacks may be controlled by means of electric or manual controls or by hydraulic microcontrols (not shown). The latter have several advantages, among which is a flexible and silent operation which is of great interest in the considered application. FIG. 5 therefore shows only a single-acting jack, in order to render the drawing more clear, with an electric control 53 and a manual control 54.

A pump 55 is driven by a motor 56 and puts under pressure hydraulic fluid drawn from a reservoir 57 through a filter 58. This hydraulic fluid under pressure is conducted to the jacks through the corresponding control systems. Inserted in series in this fluid supply line as a pressure limiter 59 with a return to the reservoir 57 in the event of overpressure. In the case of the electric control, a first safety check-valve 530 is inserted in the principal supply line of an electrically controlled slide. This slide operates in the following manner: the electromagnet 532 when carrying current permits the passage of the fluid through the passageway 531 positioned in the principal line and therefore raises the piston of the jack while, on the other hand, in the position of rest, the valve 533 prevents any supply of fluid to the jack 42.

The jack is compressed by the weight it supports. The fluid which is stopped from returning to the principal line by the valve 530 therefore flows through a throttle 534 to a second control 535 whose electromagnet 536 permits, when it is supplied with current, the passage of the fluid through a bore 539 to the reservoir 57 and the lowering of the piston of the jack. When the electromagnet is no longer supplied with current, in the position of rest, a valve 537 prevents any flow of fluid.

Thus, it can be seen that when the two electromagnets are not supplied with current and the two controls are in a state of rest, the valves 530 and 537 prevent any accidental movement of the jack which remains in a fixed position. A line 538 is adapted to supply fluid to the second jack (not shown) and it is composed of the same elements as those just described.

The manual control 54 is a control having three positions, obtained by shifting a lever 541 which acts on a slide 542, a first position that permits passage through a bore 543 to the jack to raise the piston of the jack, a second position that permits passage through a bore 544 in the opposite direction to lower the piston of the jack, and a third position whereat a part 545 blocks the circulation of the fluid under pressure. A safety valve 540 is inserted in the supply line on the upstream side of control 54. On the downstream side, in the direction of the jack a check-valve 546 permits the passage of the fluid to the jack, while a branch pipe 547 provided with a throttle 548 retards the return of fluid from the jack, since the valve 546 is closed in the return direction. The slide is then in the position in which the return fluid can be discharged through bore 544 to the reservoir 57. When it is desired to maintain the position of the jack at a given value, the slide is shifted to the position such that the element 545 is interposed in the supply and return line.

Figure 6:
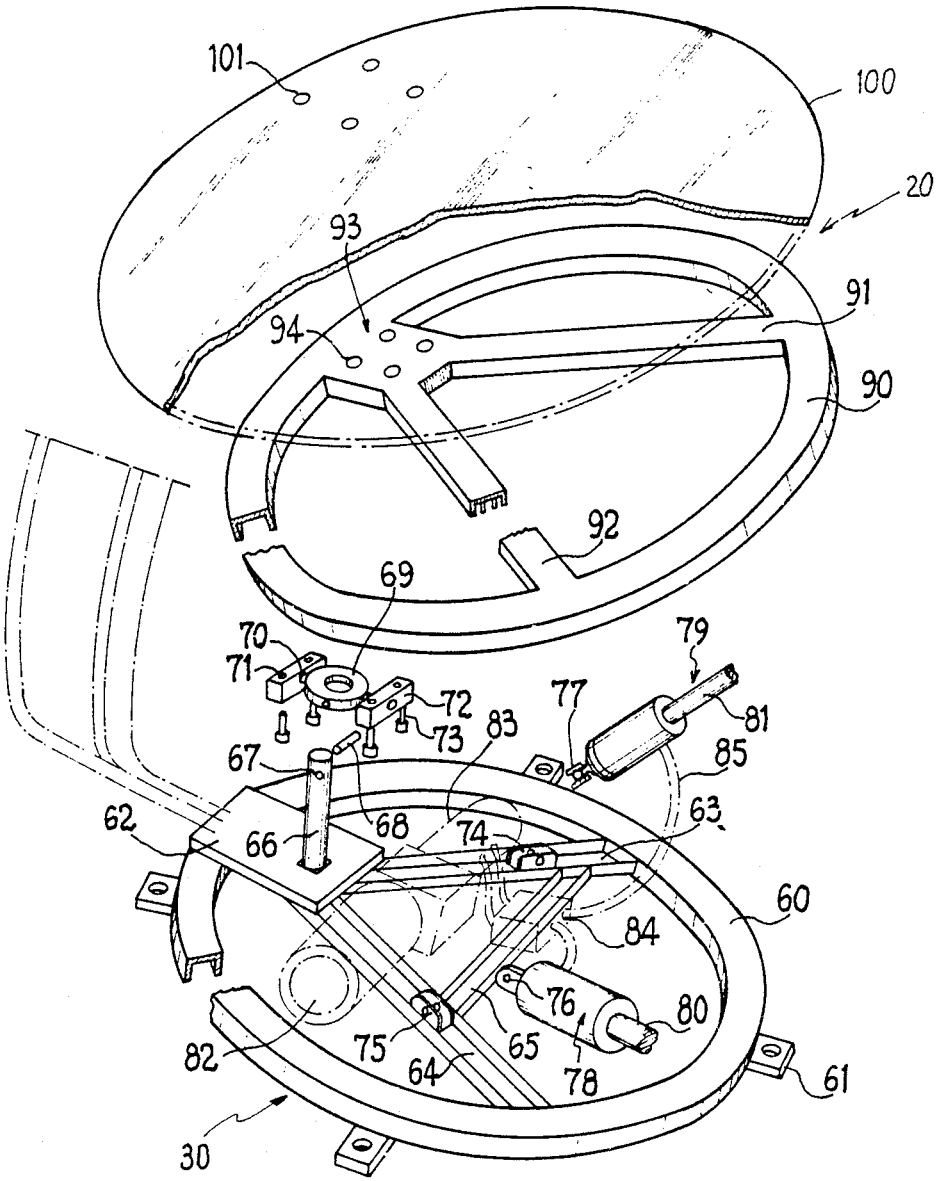
FIG. 6 is an exploded perspective view of another detailed embodiment of the device according to the invention.

FIG. 6 illustrates another embodiment of the device according to the invention.

In this FIGURE there is shown the fixed stand 30 resting on a base or directly on the ground, this stand being provided with lugs 61 for securing it. An alternative arrangement also permits, by means of lugs 61, securing the stand on a rotating device (not shown). This stand 30 is more particularly formed by a circular U-section member 60, the open side of the U facing downwardly. A base plate 62 welded to the upper side of the section member 60, plate 62 extending inwardly of the circle to a distance of about a quarter of the diameter thereof and being connected to two U-section members 63 and 64 whose open sides face upwardly and whose ends are connected to the inner surface of the inner flange of the U-section member 60. Thus, the base plate 62 and the members 63 and 64 constitute a Y-shaped structure. A strut 65 is fixed between the two branches 63, 64 of the Y-shaped structure.

A fixed support and articulation means includes a solid metal bar or post 66 welded to the upper side of the base plate 62. The height of this support is therefore defined in accordance with the maximum inclination it is desired to obtain and the place where the platform should be installed. In its upper part, support and articulation means 66 is provided with a bore 67. Inserted in this bore is a first articulation pin 68 of a universal joint arrangement having an annular member 69 carrying a second articulation pin 70. Member 69 is pivoted by pin 70 between two supports 71 and 72 that are provided with bores and screws such as 73 to permit their being mounted. Provided on each of the members 63 and 64, on the base of the U thereof and in a substantially median position therealong, are respective yokes 74 and 75 to provide a ball joint type of assembly for connecting feet 76 and 77 of jacks 78 and 79. These jacks, which are of the single-acting piston plunger type, are provided at the ends of thrust rods 80 and 81 thereof with respective ball joints. The axes of the jacks are contained in substantially vertical planes passing through the axis of the post 66. The distance between each of the feet 76 and 77 of the jacks and the vertical axis of the post 66 is less than the distance between the points of connection of the thrust rods 80, 81 to the platform 20. Disposed between the two yokes 74, 75 and the articulation and support means are the hydraulic control means controlling an electric motor 82, a pump 83, and a hydraulic directional valve 84 with flexible connections such as 85 for supplying liquid to the jacks. Separately provided is an electric and/or manual control device for the directional valve.

Provided in the upper part of the device is a movable stand 90 of circular shape and having a diameter substantially identical to that of the fixed stand 30 and constructed from a U-section member, the open side of the U-section facing toward the ground. Likewise, members 91, 92, 93 are assembled in a Y-shaped structure. Member 93 is provided with four tapped apertures such as 94 for receiving the screws 73 fixing the assembly to the universal joint carried by the support and articulation means. A circular plate 100 is superimposed on movable stand 90 and has a diameter larger than the diameter of the fixed stand 30 or of the movable stand 90. Four apertures such as 101 enable the plate 100 to be secured to the movable stand 90 by means of screws 73.

Figure 7C:
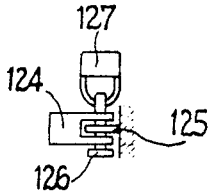
FIG. 7C is a top plan view of a detachable arch closing device.
Figure 7A:
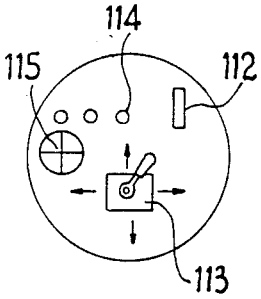
FIG. 7A is a front elevational view of the control panel.
Figure 7:
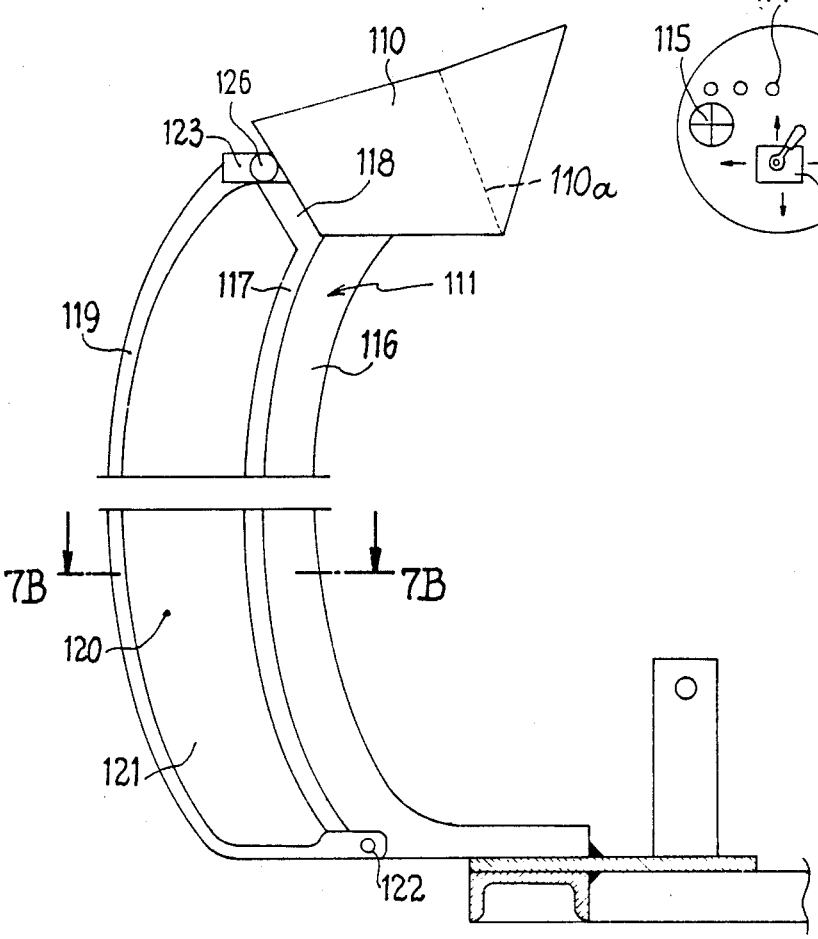
FIG. 7 is a side elevational view of a control panel and a support column which are part of a device according to the invention.

The device according to the invention is completed, as shown in FIG. 7, by a case 110 carrying on its front side a control panel **110*a* located at the upper end of a column 111**.

The case is closed in its rear part by a flap locked by a lock or any other suitable means. It contains a slot machine or actuator brought into operation by tokens and/or coins, the slot 112 of which is shown in the control panel **110*a* (FIG. 7A). Control panel 110*a* is completed by an orientation control lever 113 mounted on a ball joint and enabling the orientable platform to be shifted in all directions relative to a horizontal plane and by indicator lights such as 114 which indicate the state of the device, namely the start-stop states. Furthermore, control panel 110*a* is provided with an information system 115** indicating axial and transverse levels. Such items of information enable the players to familiarize themselves with the orientations of the platform. This control panel may also be provided with a programmable numeric control which produces in random manner successive positionings of the platform in different orientations without intervention of the user.

The column 111 is directly welded to the base plate 62. It is therefore rigid with the stand 30. This column is formed by a hollow tube 116 having a circular sectional shape through which extend the various control leads from the control panel.

Column 111 has a special shape, in particular a curved shape, so that the control panel is accessible to the player in position on the orientable platform without the column itself hindering the player during his training, but also allowing shifting of the platform. Fixed to the back of tube 116 of the column is a split tube 117 having a circular or U-shaped section, an end 118 of this tube extending to the back of the control panel 110. A slit in tube 117 faces away from the platform. Another tube 119 forms an arch relative to the first split tube 117 so as to create between the two tubes a free space 120. Tube 119 is mounted in its lower part to be pivotable about a pin 122 on the tube 116. The orientation of tube 119 is such that a slit therein is in facing relation to the slit of the tube 117 so that the two slits constitute a slideway. In a modification, both of the two split tubes may be mounted to be pivotable about the pin 122 on the tube 116 of the column 111.

Figure 7B:
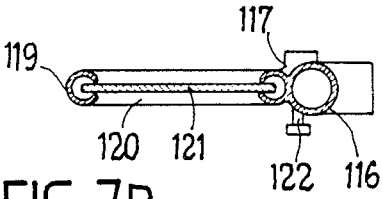
FIG. 7B is a sectional view taken on line 7B—7B of FIG. 7.

An advertising panel 121 is disposed in space 120, this panel being received in the slits in the split tubes. Such an assembly has been shown in detail in the sectional view of FIG. 7B. As the arch formed by tube 119 is pivotally mounted on the pin 122, it can be opened for facilitating the introduction of the advertising panel and this arch has in its upper part a closing means 123 shown in FIG. 7C constituted by a U-section member 124 which is positioned on each side of a tab 125 connected to the rear part of the control case 110, tab 125 and the two branches of the U-section of member 124 being bored to permit the passage therethrough of a locking pin 126 which may be locked in position by a device 127 of the padlock or any other suitable type.

The device according to the invention operates in the following manner:

With the orientable platform in its lower position and stationary under the effect of the weight of the platform, the player inserts in the slot 112 a coin or a token in order to supply power to the device. One of the indicator lights then indicates to him that the device is supplied with power and that the hydraulic circuit is ready to be put under pressure. The lever 113 enables him to incline the orientable platform as desired, but the player may also benefit from the advantages of a programmable numerical control which will impart to the platform an orientation which can be changed only by intervention of such control into a new orientation obtained at random.

When the player or the numerical control modifies the inclination of the orientable platform, the hydraulic directional valve supplies liquid to or discharges liquid from the chamber of the concerned jack through the previously-described control device.

Such an orientable platform is therefore hydraulically autonomous and it is sufficient to connect it to an electric supply by a cable in the conventional manner. Such a system has the advantage of being capable of being put out of action by a remote cutting off of the electric supply so that the device cannot be used in an untimely fashion. Furthermore, when the fixed stand is mounted on a rotating device as mentioned before, such a device permits the training of right-handed or left-handed players merely by turning the device through 180°. It is understood that this rotation can only be an alternating and not a continuous rotation so that the electric supply lead does not rotate more than 180°.

As concerns the advertising support, it may be changed at any moment by the personnel in charge who will possess means for opening the padlock and who will swing the rear arch 119 about the pin 122 after having opened the padlock and will then change the advertising panel.

The device according to the invention has the advantage of being very stable by design owing to the three supports and requires no other heavy and expensive pivotal support means.

Such a device is moreover intended for training or teaching. In the last-mentioned case, there will be many shocks and forces imported to the orientable platform. In the device according to the invention, the shocks are directly taken by the support and articulation means with a universal joint assembly. The jacks are merely subjected to compression forces to the exclusion of any tensile force. Tension springs may however be added for compensating for an exceptional tensile force when the player takes up his position on the platform.

In the particular application to golf, it is found that with the device according to the invention, the point of departure of the ball is always located at the same height relative to the ground, which facilitates installation in the case where the device is buried and in the case where the point of departure of the ball must be at the level of the ground.

I claim:

1. A training or exercising device, in particular for the practice of golf wherein a player practices a golf swing in a swing direction, said device comprising:

a fixed stand;

an orientable platform above said fixed stand for supporting a player, said platform including a movable stand;

support and articulation means between said fixed stand and said platform for defining a point about which the orientation of said platform relative to said fixed stand may be changed by articulation, said support and articulation means comprising a post having a lower part connected to said fixed stand and an upper part and a universal joint interconnecting said upper part of said post and said movable stand;

two actuating jacks, between said fixed stand and said platform, forming means for varying the inclination of said platform about said point relative to said fixed stand;

ball joints connecting said two jacks respectively to said fixed stand and to said movable stand;

said support and articulation means and said two jacks being disposed substantially at respective apices of an equilateral triangle having a center located substantially at the center of said platform; and said two jacks being positioned relative to said support and articulation means such that a line extending between said two jacks extends approximately parallel to a direction of swing of a player to stand on said platform and swing at a ball approximately at said support and articulation means.

2. A device according to claim 1, wherein said movable stand and said fixed stand each comprise a frame having at least one member carrying said post of said support and articulation means and said two jacks.

3. A device according to claim 2, wherein each said frame is circular and said at least one member comprises a base plate carrying said post of said support and articulation means and two branches which diverge from said base plate and to which respective said jacks are articulated.

4. A device according to claim 2, wherein said frames and said at least one member are U-section members.

5. A device according to claim 1, wherein said jacks are hydraulic, and said device further comprises means for controlling said jacks, said control means comprising, in combination, an electric motor, a pump, a directional valve, and a control element for said directional valve, said control means being located on said fixed stand between said support and articulation means and said two jacks.

6. A device as claimed in claim 1, wherein said two jacks are located relative to said platform at approximately the positions of respective feet of a player to stand on said platform on said line.

7. A device as claimed in claim 1, wherein said two jacks are single acting jacks.

8. A training or exercising device, in particular for the practice of golf wherein a player practices a golf swing in a swing direction, said device comprising:

a fixed stand;

an orientable platform above said fixed stand for supporting a player, said platform including a movable stand;

support and articulation means between said fixed stand and said platform for defining a point about which the orientation of said platform relative to said fixed stand may be changed by articulation, said support and articulation means comprising a post having a lower end connected to said fixed stand and an upper end having connected thereto a ball joint, and a hemispherical cavity in said movable stand in which said ball is engaged;

two actuating jacks, between said fixed stand and said platform, forming means for varying the inclination of said platform about said point relative to said fixed stand, said jacks having lower ends connected to said fixed stand and upper ends on which are provided slidable shoes cooperative with the movable stand;

said support and articulation means and said two jacks being disposed substantially at respective apices of an equilateral triangle having a center located substantially at the center of said platform; and said two jacks being positioned relative to said support and articulation means such that a line extending between said two jacks extends approximately parallel to a direction of swing of a player to stand on said platform and swing at a ball approximately at said support and articulation means.

9. A device according to claim 8, wherein said movable stand and said fixed stand each comprise a frame having at least one member carrying said post of said support and articulation means and said two jacks.

10. A device according to claim 9, wherein each said frame is circular and said at least one member comprises a base plate carrying said post of said support and articulation means and two branches which diverge from said base plate and to which respective said jacks are articulated.

11. A device according to claim 9, wherein said frames and said at least one member are U-section members.

12. A device as claimed in claim 8, wherein said two jacks are located relative to said platform at approximately the positions of respective feet of a player to stand on said platform on said line.

13. A device as claimed in claim 8, wherein said two jacks are single acting jacks.

14. A device according to claim 8, wherein said jacks are hydraulic, and said device further comprises means for controlling said jacks, said control means comprising, in combination, an electric motor, a pump, a directional valve, and a control element for said directional valve, said control means being located on said fixed stand between said support and articulation means and said two jacks.

15. A training or exercising device, in particular for the practice of golf wherein a player practices a golf swing in a swing direction, said device comprising:

a fixed stand;

an orientable platform above said fixed stand for supporting a player, said platform including a movable stand;

support and articulation means between said fixed stand and said platform for defining a point about which the orientation of said platform relative to said fixed stand may be changed by articulation;

two actuating jacks, between said fixed stand and said platform, forming means for varying the inclination of said platform about said point relative to said fixed stand;

said support and articulation means and said two jacks being disposed substantially at respective apices of an equilateral triangle having a center located substantially at the center of said platform;

said two jacks being positioned relative to said support and articulation means such that a line extending between said two jacks extends approximately parallel to a direction of swing of a player to stand on said platform and swing at a ball approximately at said support and articulation means; and said support and articulation means having an axis and said jacks having axes contained in substantially vertical planes passing through said axis of said support and articulation means.

16. A device according to claim 15, wherein said jacks have foot portions and upper thrust rods and the distance between said foot portions of said jacks and said vertical axis of said support and articulation means is less than the distance between points at which said thrust rods of said jacks are connected to said platform and said vertical axis of said support and articulation post.

17. A device as claimed in claim 15, wherein said two jacks are located relative to said platform at approximately the positions of respective feet of a player to stand on said platform on said line.

18. A device as claimed in claim 15, wherein said two jacks are single acting jacks.

19. A device according to claim 15, wherein said jacks are hydraulic, and said device further comprises means for controlling said jacks, said control means comprising, in combination, an electric motor, a pump, a directional valve, and a control element for said directional valve, said control means being located on said fixed stand between said support and articulation means and said two jacks.

20. A training or exercising device, in particular for the practice of golf wherein a player practices a golf swing in a swing direction, said device comprising:

a fixed stand;

an orientable platform above said fixed stand for supporting a player;

support and articulation means between said fixed stand and said platform for defining a point about which the orientation of said platform relative to said fixed stand may be changed by articulation;

two actuating jacks, between said fixed stand and said platform, forming means for varying the inclination of said platform about said point relative to said fixed stand;

said support and articulation means and said two jacks being disposed substantially at respective apices of an equilateral triangle having a center located substantially at the center of said platform;

said two jacks being positioned relative to said support and articulation means such that a line extending between said two jacks extends approximately parallel to a direction of swing of a player to stand on said platform and swing at a ball approximately at said support and articulation means; and a column connected to said fixed stand and having an upper part, and a control panel on said upper part of said column.

21. A device according to claim 20, wherein said column includes a slideway defining a space for receiving an advertising support.

22. A device according to claim 21, wherein said slide-way comprises two tubes having slits which are oriented in confronting relation to each other, at least one of said tubes being articulated at a lower part thereof to a lower part of said column, and means for detachably fixing said at least one tube to an upper part of said column in a region located at the rear of said control panel.

23. A device as claimed in claim 20, wherein said two jacks are located relative to said platform at approximately the positions of respective feet of a player to stand on said platform on said line.

24. A device as claimed in claim 20, wherein said two jacks are single acting jacks.

25. A device according to claim 20, wherein said jacks are hydraulic, and said device further comprises means for controlling said jacks, said control means comprising, in combination, an electric motor, a pump, a directional valve, and a control element for said directional valve, said control means being located on said fixed stand between said support and articulation means and said two jacks.

26. A training or exercising device, in particular for the practice of golf wherein a player practices a golf swing in a swing direction, said device comprising:

an orientable support capable of assuming two diametrically opposed positions;

a fixed stand mounted on said orientable support;

an orientable platform above said fixed stand for supporting a player;

support and articulation means between said fixed stand and said platform for defining a point about which the orientation of said platform relative to said fixed stand may be changed by articulation;

two actuating jacks, between said fixed stand and said platform, forming means for varying the inclination of said platform about said point relative to said fixed stand;

said support and articulation means and said two jacks being disposed substantially at respective apices of an equilateral triangle having a center located substantially at the center of said platform; and said two jacks being positioned relative to said support and articulation means such that a line extending between said two jacks extends approximately parallel to a direction of swing of a player to stand on said platform and swing at a ball approximately at said support and articulation means.

27. A device as claimed in claim 26, wherein said two jacks are located relative to said platform at approximately the positions of respective feet of a player to stand on said platform on said line.

28. A device as claimed in claim 26, wherein said two jacks are single acting jacks.

29. A device according to claim 26, wherein said jacks are hydraulic, and said device further comprises means for controlling said jacks, said control means comprising, in combination, an electric motor, a pump, a directional valve, and a control element for said directional valve, said control means being located on said fixed stand between said support and articulation means and said two jacks.

* * * * *